United States Patent [19]

Makar

[11] Patent Number: 4,932,663

[45] Date of Patent: Jun. 12, 1990

[54] GOLF PRACTICE SWING TEE MAT

[76] Inventor: John Makar, 1 E. 26th Pl., Tulsa, Okla. 74114

[21] Appl. No.: 371,062

[22] Filed: Jun. 26, 1989

[51] Int. Cl.[5] ..... A63B 69/36

[52] U.S. Cl. ..... 273/195 A; 273/176 J; 273/199 A; 273/198

[58] Field of Search ..... 273/195 R, 195 A, 195 B, 273/196, 197 R, 197 A, 198, 183, 183 A, 176 J, 176 H, 199 A

[56] References Cited

U.S. PATENT DOCUMENTS

| | | | |
|---|---|---|---|
| 3,473,811 | 10/1969 | Lees | 273/195 R |
| 3,599,982 | 8/1971 | Elesh | 273/195 A |
| 3,712,628 | 1/1973 | Boss | 273/195 A |
| 4,106,772 | 1/1978 | Krawagna | 273/186 R |
| 4,311,312 | 1/1982 | O'Brien | 273/195 A |

*Primary Examiner*—George J. Marlo

[57] ABSTRACT

A golf swing practice mat comprising a rigid frame retaining an artificial turf mat under tension within the frame and along the upper edge of the frame. During use the artificial turf mat held under tension will support a golf ball with or without the use of a tee and will be displaced downward upon impact with a golf iron or wood in a manner such as to simulate the feel of a golf swing on a golf tee or a natural fairway. The device can be further used with selected top surface layer to simulate a divot producing golf shot from the fairway or rough as well as a golf shot out of a sand trap.

7 Claims, 4 Drawing Sheets

GOLF PRACTICE SWING TEE MAT

BACKGROUND OF THE INVENTION

1. Field of the Invention

This invention relates to a golf tee mat. More specifically, the invention relates to a full arc golf swing mat with divot that will support a golf ball either with or without a tee and will yield under impact by the head of an iron or a wood in a manner similar to the golf course tee, fairway, rough or sand trap.

2. Description of the Prior Art

A basic concept of providing a driving range for the practice of your golf swing with a golf tee mat using real golf balls and clubs is an accepted and well known practice. Historically, such golf tee mats were made out of rubber containing material in the form of successive vertical layers having gaps therebetween for water drainage much like a conventional door mat and more recently artificial grass turf has been employed. Such golf tee mats will typically be further equipped with a rubber tee protruding through a hole in the mat and extending upwards to support a golf ball that is to be struck by the golf club. Such prior art golf tee mats are known to be non-resilient and as such, are of value only in practicing driving with a wood from a tee. Because of the potential of damaging the wood when using such a golf tee mat, various improvements have been proposed. For example, U.S. Pat. No. 3,599,982 discloses the use of a brush element inserted into a rubber mat with the bristles directed upwards to support the golf ball during the practice swing. Although such a golf tee mat is reportedly useful for practicing both "wood" shots and "iron" shots, the device is very unforgiving if your practice swing is even slightly off and as such, does not simulate the feel or response associated with the natural turf of a fairway. Similarly, U.S. Pat. No. 4,106,722 discloses a resilient golf swing practice base that involves a convex profile made out of a resilient material that supports the golf ball at the apex of the convex profile which reportedly can be used for practicing your golf swing with a wood or iron. Although such improved golf practice tees offer some improvement in terms of resilience upon impact, they are again very unforgiving if your swing is slightly off such as when the golf club head strikes too low. Also, even when your golf swing is correct, the improved devices do not properly account for "give" and/or energy absorption associated with the tremendous lateral and descending swing forces of the club head upon the surface below the ball. This is particularly true when you consider the normal residence time and turf contact distance associated with an iron shot or wood shot off of a fairway wherein a divot is to be expected. These physical differences as well as the visual aspects of the prior art golf mats are found to be highly detrimental to efficient and effective practice.

SUMMARY OF THE INVENTION

In view of the problems associated with the prior art practice golf tee mats, the present invention provides an improved golf tee mat that during use more accurately simulates what the golfer experiences during a conventional golf course iron shot or wood shot from a tee, fairway, rough, or sand trap. The device according to the present invention more appropriately dissipates and absorbs the club head forces, both laterally and vertically, upon contact with the tee mat by resolving and directing these forces in various directions simultaneously. Furthermore, because of the "give" in the surface of the improved golf practice tee mat according to the present invention, the residence time and club head contact distances is virtually identical to that experienced in the fairway and as such, again more accurately simulates the feel and experience associated with an iron shot or wood shot off of the fairway or the like.

Thus the present invention provides a golf practice mat comprising:

(a) a rigid frame means to be used during golf practice such that the upper edge of said rigid frame means will be substantially level and at grade and such that said rigid frame means will retain an artificial turf means substantially covering the entire interior of said rigid frame means at grade under tension such that an artificial turf means so retained will be free to move downward upon impact with a golf iron or wood and to return, resiliently, to its original level position after impact; and (b) an artificial turf means operatively attached to said rigid frame means and held under tension such as to cover substantially the entire interior of said rigid frame means and such as to be held substantially level at grade during use as a golf practice mat wherein said artificial turf means supports a golf ball during a practice swing and moves downward upon impact with a golf iron or wood in a manner simulating a natural golf course.

It is an object of the present invention to provide a golf tee mat that when employed as a practice tee will move and stretch downward upon impact by the head of the golf club and will distribute and absorb the force of the golf swing in a manner such as to simulate a golf shot off of a tee, fairway grass, out of the rough or a sand trap and the like. It is a further object of the present invention to provide such a golf tee mat wherein the user can select which type of natural occurring surface is to be simulated. Fulfillment of these objectives and the presence and fulfillment of other objects will be apparent upon complete reading of the specification and claims taken in conjunction with the attached drawings.

DESCRIPTION OF THE PREFERRED EMBODIMENTS

Figure 1:
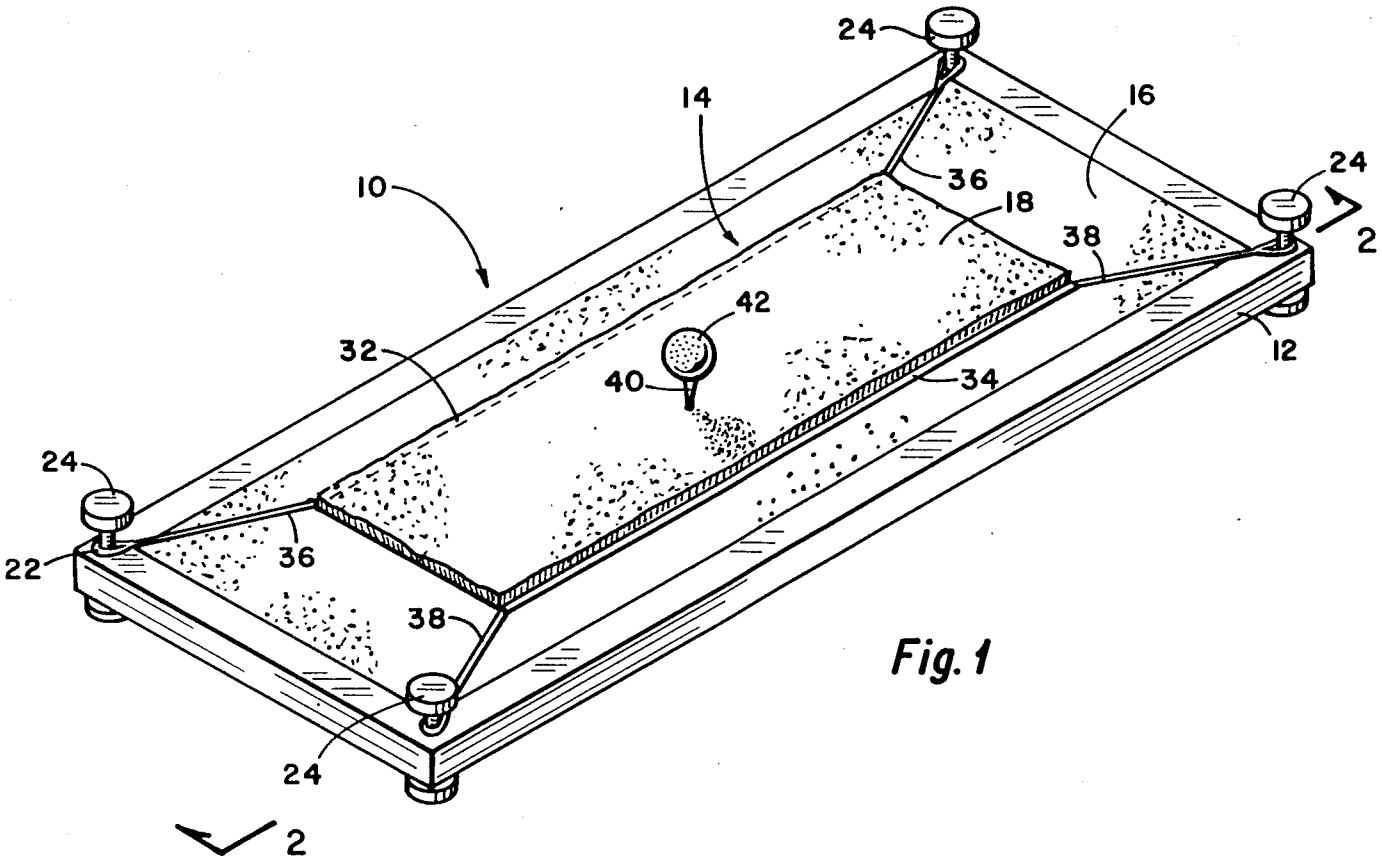
FIG. 1 is a perspective view of one preferred embodiment of the golf practice mat according to the present invention.
Figure 3:
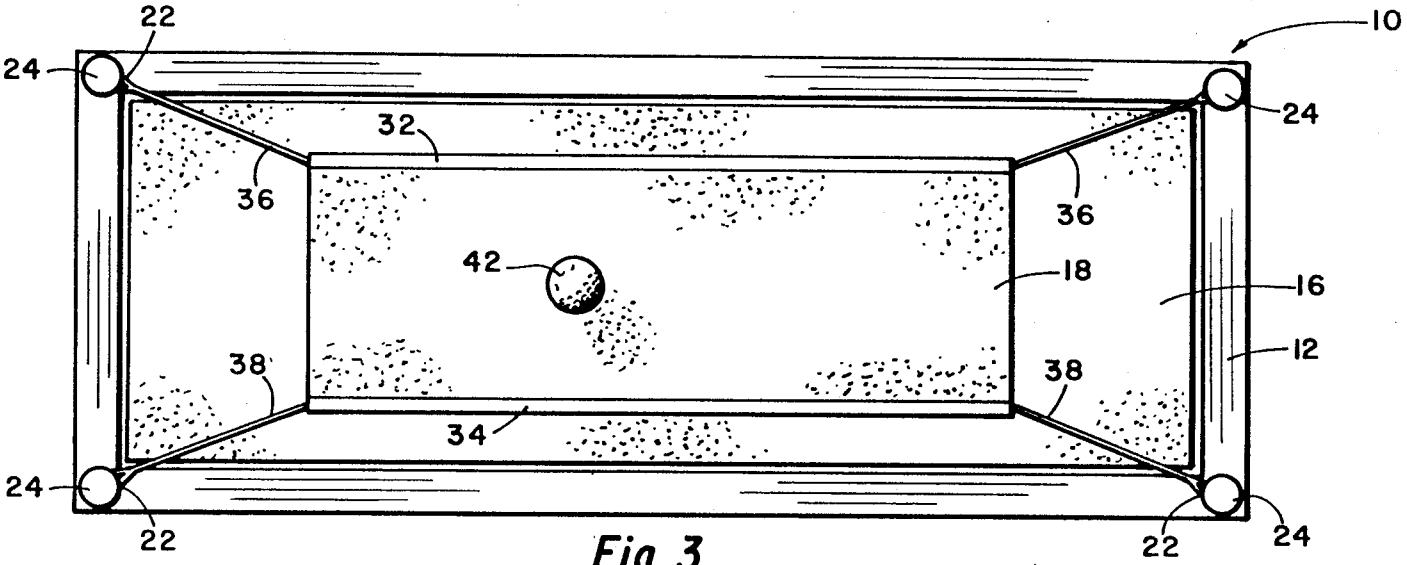
FIG. 3 is the top plan view of the golf practice mat of FIG. 1.

The improved golf tee mat according to the present invention, how it functions and operates, how it differs from previous devices and the advantages over the prior art devices can perhaps be best explained and understood by reference to the attached drawings. FIG. 1 illustrates one preferred embodiment of the improved golf tee mat according to the present invention, generally designated by the numeral 10. The golf tee mat 10 comprises a rigid frame member or means 12 which in this specific embodiment is a rectangular frame with an open rectangular center. Suspended under tension near the top edge of the frame 12 is a mat or artificial turf means 14. This artificial turf means 14 covers substantially the entire interior of the frame and in this specific embodiment consists of a pair of layers 16 and 18 of fabric or artificial grass like material superimposed on top of each other and held under tension to the frame 12 and resting in a spring tensioned cable system 20 as more clearly illustrated in FIGS. 2 and 4.

Figure 2:
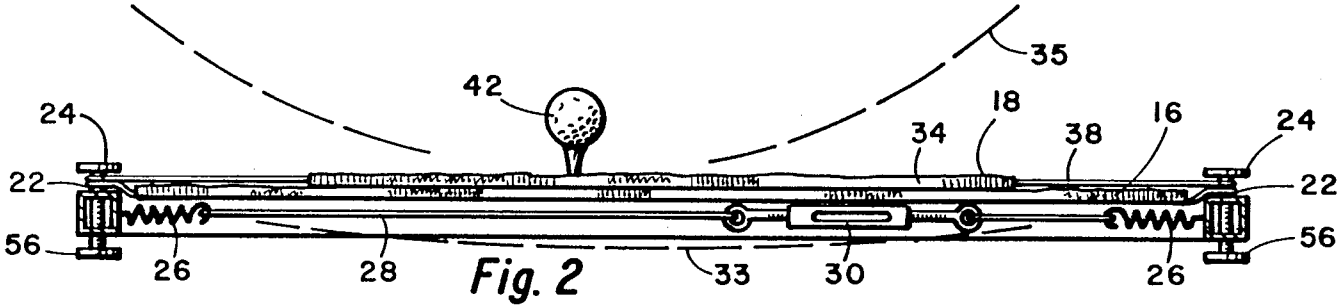
FIG. 2 is a cross-sectional side view of the golf practice mat of FIG. 1 as seen through line II—II with the arc of the swing of a golf tee shot and a divot producing golf shot superimposed.
Figure 4:
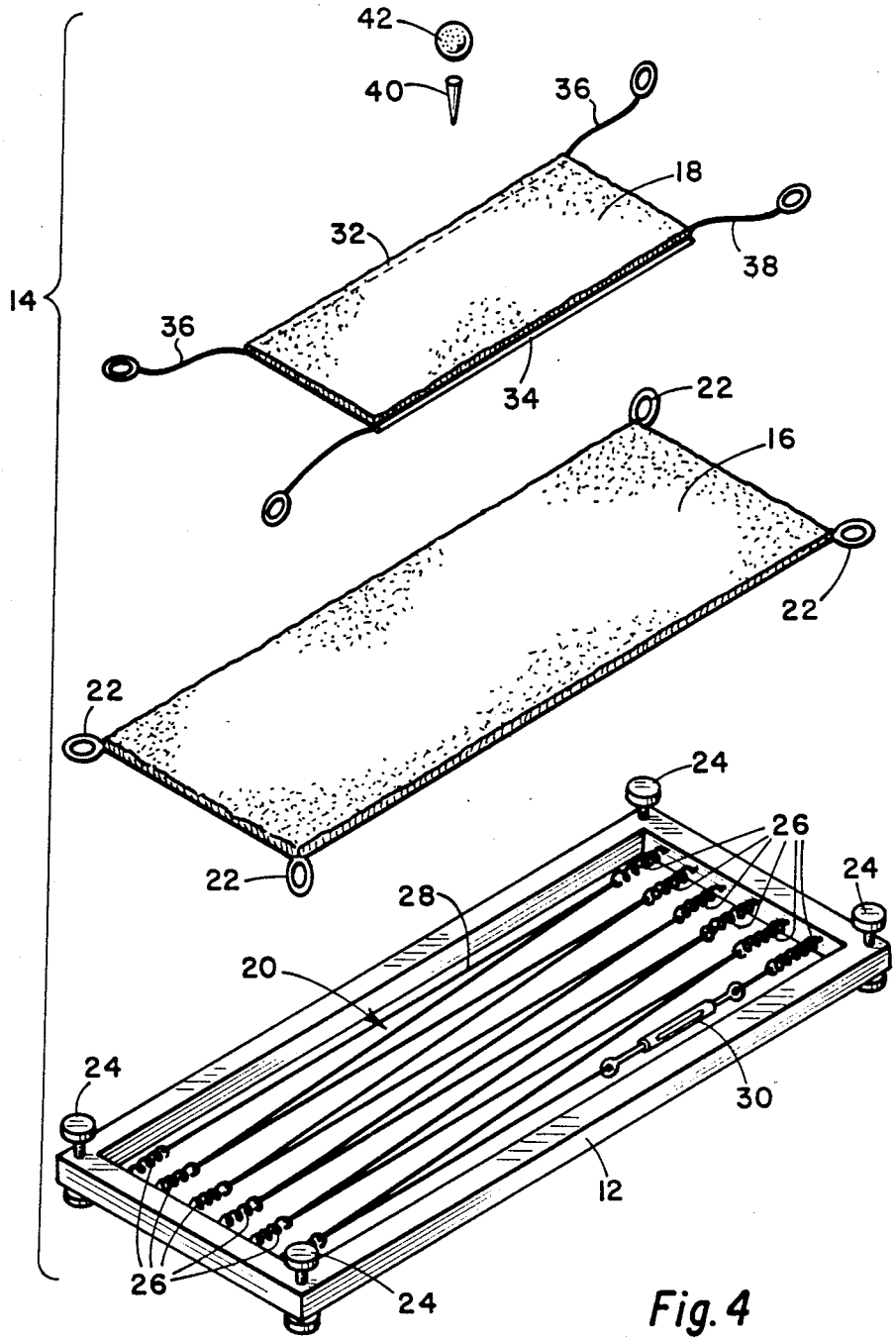
FIG. 4 is an exploded view of the golf practice mat of FIG. 1 illustrating the various layers making up the carpeted mat.

As shown in the partial cross-sectional view of FIG. 2 and the exploded view of FIG. 4, the artificial turf means 14 suspended under tension on the top edge of frame 12 is made up of several layers of fabric and/or carpet like material. The first visible layer of the artificial turf means, in this specific embodiment, actually involves a layer of artificial turf 16 and a supporting tensioned cable system 20 underneath this ground layer. The layer of artificial grass fabric or ground layer 16 is held to the frame 12, in this specifically illustrated embodiment, by use of four elastic tension straps 22 forming eyelets that engage one of the height adjustment knobs 24 near the corners of frame 12. The cable system 20 underneath this artificial grass fabric layer 16 involves a plurality of springs 26 on the inner perimeter of frame 12 with a cable 28 crisscrossed back and forth along the long dimension of frame 12 with a turnbuckle 30 present such as to create tension in the cable 28 (see FIG. 4). The combination of layer 16 and cable system 20 is predominantly structural in nature in that it represents an elastic support bed or subsurface for the upper layers. To a great extent, this elastically held artificial grass like layer 16 and support cable system 20 represents the major source of tension and support associated with the carpet means 14. As suggested by the dashed line 33 in FIG. 2, this cable support system 20 and the rest of the artificial turf means 14 are intended to elastically move downward within frame 12 during impact by the golf club head (the path of which is illustrated by dashed line 35) and then return to the level configuration after impact.

Superimposed on the support layers is a simulated turf layer 18. As illustrated in FIGS. 2 and 4, this turf layer 18 is a carpet like fabric characterized as having a face yarn, or nap, that represents artificial grass of selected length thus simulating short grass of a fairway, long or short grass of the rough and the like (as explained more fully later). In this specifically illustrated embodiment, the long edges of fabric layer 18 are stitched into two parallel channels 32 and 34 with elastic straps 36 and 38 extending therethrough. Loops are provided at the ends of straps 36 and 38 such that the simulated turf layer 18 can be easily mounted to frame 12 again by use of knobs 24. Because of the relatively large mass of the artificial turf layer 18 and the ability to move along the direction of the elastic straps 36 and 38, the fabric layer 18 is particularly suited to practicing iron shots and wood shots off of fairway grass or the like. This structure can also be used to practice wood shots off of a tee. As further illustrated in FIGS. 1 through 4, a conventional golf tee 40 can be pushed through the fabric layer 18 and used to support a golf ball 42. In the alternative, a hole can be provided through which a rubber tee can be inserted or the tee can be removed and the ball can rest directly on the face yarn of the fabric layer.

For purposes of describing and claiming the present invention, the ground layer 16 and supporting spring and cable system 20 represents what is referred to as the ground turf means for simulating the ground of the golf course. Because of the resilient support bed, the entire ground turf means "gives" vertically upon impact by the descending golf club head. Thus, the shock associated with taking a divot is absorbed by the ground turf means in a manner that simulates the ground of a natural golf course. Similarly, the simulated turf layer 18, for purposes of this invention, is described and claimed as the grass turf means for simulating the natural grass of a golf course. This grass turf means is placed on top of the ground turf means such that it slides laterally upon impact by the swinging golf club head. Because the entire ground turf means slides upon impact, the horizontal component of the shock associated with taking a divot is frictionally absorbed in a manner analogous to the natural grass of a golf course. It is the combination of ground turf means and the grass turf means that is felt to be particularly novel and unique relative to any previous golf practice mat. The combination of the two results in resolving the club head shock into the vertical give of the ground turf means and the horizontal slide of the grass turf means. The absorption of the descending golf club head forces in this manner is felt to be critical in simulating the feel and touch associated with a real golf shot off of a golf course fairway or the like.

Figure 5:
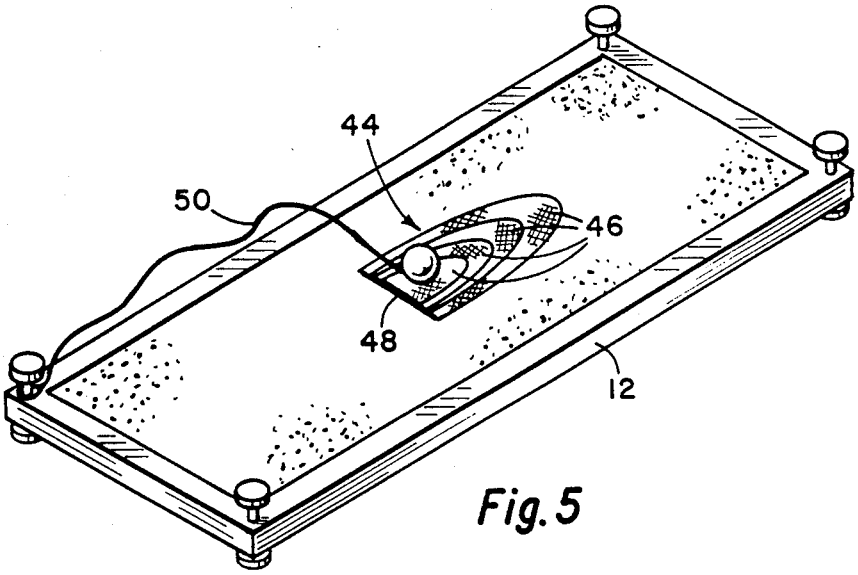
FIG. 5 is a perspective view of another embodiment of the golf practice mat according to the present invention illustrating a tethered divot.

FIG. 5 illustrates another alternate embodiment of the present invention wherein artificial grass top layer 18 is removed from frame 12 and a tethered divot simulating surface 44 is placed on the artificial grass fabric ground layer 16. Typically, this divot simulating surface 44 involves a plurality of net-like fabric layers 46 of diminishing size stacked vertically on top of each other and sewed along a common front edge 48. The composite is then tied to the frame by a cord 50 such as to tether the divot and retrieve it after the golf stroke. By employing a stack of net-like fabric layers of diminishing surface area, the entry of the golf club head into the unsewn edge during the practice swing will simulate the degree to which the golf club penetrates below the ball and the impact creating different size divots. This feature is particularly useful in practicing sand trap shots.

Figure 6:
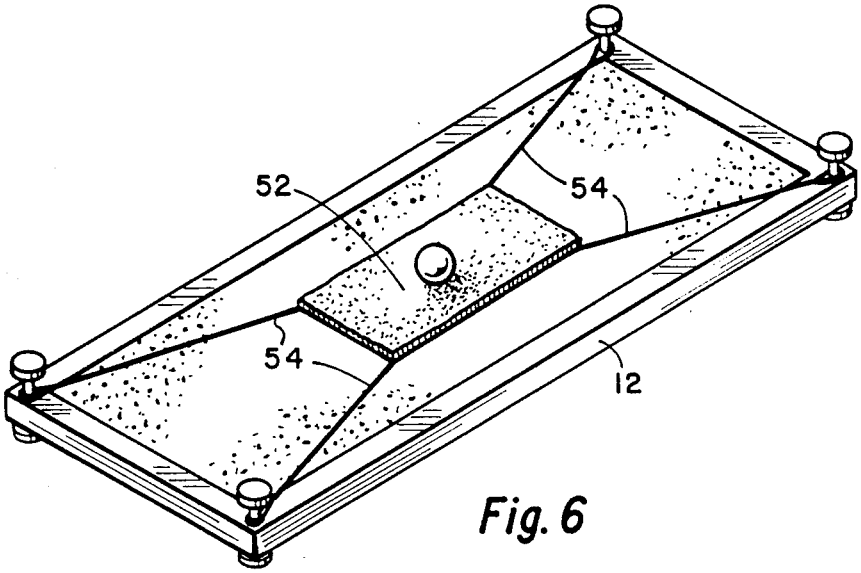
FIG. 6 is a perspective view of yet another embodiment of the golf practice mat according to the present invention.

FIG. 6 illustrates an alternate embodiment for practicing divot shots wherein the artificial turf surface 52 is relatively small when compared to the top surface 18 of FIG. 1. Also, the elastic tie down chords 54 of this embodiment are relatively long allowing for greater longitudinal movement of the turf surface 52 upon impact. In this particular embodiment, the face yarn of turf surface 52 is relatively long thus simulating a divot shot out of the rough or a long grass fairway. In principle, the mass of the divot surface 52, the tension of tie down chords 54 and the length of the face yarn can be varied to simulate various golf course conditions.

In order to use the improved golf tee mat according to the present invention, the frame is either placed on the ground of slightly below grade such that the top edge and suspended artificial turf means is level and substantially at the level at which the golfer is standing. The adjustable legs 56 (see FIG. 2) or the like can be used to ensure that the mat is level. During practice, the user selects the particular surface desired according to which type of golf shot is to be simulated. This is accomplished in the specific embodiment illustrated in FIGS. 1–4 by selectively attaching the desired top surface to the frame 12. In other words, if one wishes to practice driving with a wood from a tee the entire artificial turf means as illustrated in figures of the drawings is left intact. Removal of just the tee will allow practicing of shots from the fairway. Removal of the top layer 18 and replacing with the divot surface will allow the user to practice high grass and soft fairway shots using irons or woods. Using the tethered surface of FIG. 5 will allow the user to practice shots from a sand trap.

The actual construction of the improved golf tee mat according to the present invention, can be out of any conventionally available material using any of the assembly and fabrication methods generally known in the art. For example, the frame member can be fabricated from generally any structural material, such as, for example, but not limited thereto, various metals or metal alloys, wood or wood derived products or various plastics such as fiber reinforced plastics, extruded plastic profiles or pipe, injection molded or vacuum formed parts or the like. It should be appreciated that the rigid frame can be made in various configurations and shapes other than the illustrated figures and can be either a single piece or assembled from sub-components. The frame can also be entirely enclosed by virtue of a solid bottom surface provided sufficient clearance is present to afford the artificial turf means to deflect downward upon impact by the golf club head and preferably rain water drainage or the like is provided. The frame member can also be equipped with various types of leveling mechanisms or adjustment legs to ensure that the carpet means is at grade and level.

The artificial turf member to be suspended under tension along the top edge of the frame member is preferably any fabric or carpet like material that will stretch during downward movement caused by the golf club head impact and then elastically return and that will simulate the texture of a conventional golf course (either grass or sand). Preferably, the artificial turf means is fabricated out of a plurality of fabric or carpet like layers; however, it is contemplated that a singular unitary construction or assembly could be used and as such, should be considered equivalent for purposes of the present invention. When using an artificial turf means as illustrated in the drawings, the bottom structural layer is preferably made out of synthetic fibers woven into a durable and strong fabric with face yarn tufted therethrough as generally known in the art. Various elastomeric and/or thermoplastic film coatings can be readily employed such as generally known in the recreational synthetic grass surface art. The various grass or turf like layers employed in a superimposed fashion on top of the structural layer can be generally made out of any synthetic turf as commonly known in the art or a composite of several layers of open weave netting or the like. In particular and preferably, various types of indoor/outdoor grades of carpet are to be used including by way of example, but not limited thereto, indoor/outdoor carpet made from leno weave polypropylene primary backing with or without a similar secondary backing and/or foamed polyurethane backing and a face yarn of nylon or polyolefin fiber. The length of the face yarn can be selected to simulate either tall grass or short grass conditions (i.e., pile height, texture). The elastomeric strap employed to hold the various pieces of carpet in place are selected both in terms of length and tension (elastic force) such as to produce drag and resistance to the golf head upon impact. The mass of the divot layer can also be selected to simulate either a grass divot or even a sand trap shot. Also, color and texture of the face yarn can be selected to simulate the aesthetics of a golf course.

The mounting of the artificial turf means to the rigid frame can be accomplished by any of the methods generally known in the art. Thus, as an alternative to the use of a plurality of springs and cables illustrated in the drawings, various elastomeric ties including the use of a tie string or wire and a trampoline like fabric subsurface or direct fastening to the frame can be employed. Also, various method of adjusting the tension such as the use of tension rollers or the like can be employed and should be considered equivalent for purposes of this invention.

The following example is presented to further illustrate and demonstrate the improved golf tee mat according to the present invention.

EXAMPLE I

A golf practice mat as illustrated in FIGS. 1 through 4 was manufactured using ¾" square steel tubing for the frame. The dimensions of the frame were 17 inches wide by 49.5 inches in length. Steel cable 1/16 in diameter was used in combination with a series of evenly spaced springs and a turn buckle to create the crisscrossing wire support structure within the interior of the rectangular opening in the frame. The corner of the frame was equipped with thread legs to level the practice mat. A 15.5 inch wide by 48 inch long piece of artificial grass turf fabric manufactured by Playfield Industries, Inc. of Chatsworth, Ga., sold under the trade name of TEE-TURF and meeting the following specification was employed as the ground turf surface resting on the steel tensioned cable.

| | Specification |
|---|---|
| Pile Yarn | 3800 Denier Knit-De-Knit Olefin |
| Interliner | Woven Stabilized W/13 Warp Ends, 18 Fill Ends Woven Stabilized W/20 Warp Ends, 28 Fill Ends |
| Fabric Construction | Tufted 3/16"Gauge |
| Fusion Bonding | Polyurethane |
| Pile Yarn Weight | 32 OZ./Sq. Yd. |
| Interliner Weight | 7.5 Oz./Sq. Yd. |
| Fusion Bonding Weight | 24.0 Oz./Sq. Yd. |
| Total Weight | 63.5 Oz./Sq. Yd. |
| Pile Units | 9.0 Per Inch |
| Pile Height | .56 |
| Color | Lawn Green |

Each of the four corners of the ground turf surface layer had one inch wide elastic straps sewn in place such as to stretch over the frame and engage to the retention pins. A 13 inch wide by 36 inch long piece of TEE-TURF with a nylon sleeve 0.5 inch wide sewn along each long edge was used as the grass turf surface layer. An elastic chord ⅛ inch in diameter was threaded through each edge sleeve and tied off in a loop at each end such as to attach to the frame pins and rest above the ground turf surface. During use with either an iron or wood, the golf practice mat simulated the feel of a natural golf course fairway. A wooden golf tee when manually pushed through the TEE-TURF material supported a golf ball for practicing tee shots.

EXAMPLE II

In order to simulate high grass divot shots, an artificial turf surface made up of ten layers of green nylon netting was produced as shown in FIG. 5. Each layer was cut from $\frac{7}{8}$ inch knotless square mesh netting sold by Midlake, Inc. of Knoxville, Tenn., under the trade name #420 KNOTLESS. Each successive layer was slightly smaller than the layer directly below and the bundle was sewn along one leading edge with a four foot long chord as a tether attached to one corner. The use of the relatively large mesh and resulting frayed edges after cutting resulted in an appearance and behavior of a divot produced during a golf shot from the rough of a golf course.

EXAMPLE III

In a manner analogous to Example II, ten layers of #504 archery netting with $\frac{3}{8}$ inch square mesh opening supplied through Midlake of Knoxville, Tenn., was sewn into a divot surface with tether chord. When employed as the golf ball supporting surface of the golf practice mat of Example I, the behavior of a sand trap golf shot was simulated.

The benefits and advantages associated with the present invention are felt to be numerous and significant. In addition to preserving the best features of previous practice golf tee mats, the present golf tee mat can be used with a full swing with virtually no fear of the golfer receiving a shock from striking a rigid sub-support member upon which the practice tee is resting Furthermore, this feature is present whether practicing a golf swing with woods or irons. Because of the resilient construction of the suspended carpet and the inherent multi-directional dissipation of impact energy associated with bi-directional tension on the suspended carpet, the duration and feel including the downward deflection of the suspended carpet during impact is highly reminiscent of what a golfer actually experiences during the play of the game. By selecting and controlling the composition (i.e., weight, pile height, texture and tension) of the respective layers of the suspended carpet, various types of golf shots can be readily simulated from driving off of a tee, to either a wood or iron shot off of either short grass or long grass and even a shot out of a sand trap. In addition to the above, because of the ability to select the appearance of the top surface of the carpet, the aesthetics associated with the natural golf shot (e.g., texture and color of fairway or sand trap) can be readily duplicated, all of which quickly alleviates any fear or tendency to be hesitant during the golf swing, thus leading to a more natural and beneficial practice.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

I claim:

1. A golf practice mat comprising:

(a) a rigid frame means to be used during golf practice such that the upper edge of said rigid frame means will be substantially level and at grade and such that said rigid frame means will retain an artificial turf means substantially covering the entire interior of said rigid frame means at grade under tension such that an artificial turf means so retained will be free to move downward upon impact with a golf iron or wood and to return, resiliently, to its original level position after impact; and (b) an artificial turf means comprising at least one fabric layer operatively attached to said rigid frame means about the entire perimeter of said fabric layer and thus held under bi-axial tension such as to cover substantially the entire interior of said rigid frame means and such as to be held substantially level at grade during use as a golf practice mat wherein said artificial turf means supports a golf ball during a practice swing and moves downward upon impact with a golf iron or wood in a manner simulating a natural golf course.

2. A golf practice mat of claim 1 wherein said artificial turf means further comprises:

(a) a spring and cable tension means for supporting said artificial turf means within the interior of said rigid frame;

(b) a ground turf means comprising at least one fabric layer operatively attached to said rigid frame means about the entire perimeter of said fabric layer and thus held under bi-axial tension such as to cover substantially the entire interior of said rigid frame means and resting on said spring and cable tension means; and (c) a grass turf means for resting on said ground turf means and for supporting a golf ball to be hit off of said golf practice mat.

3. A golf practice of mat of claim 2 wherein said grass turf means is a layer of synthetic grass fabric with elastic straps to hold the synthetic grass fabric in place.

4. A golf practice mat of claim 2 wherein said grass turf means is a plurality of layers of fabric netting sewn together along one edge and having a strap attached thereto to tether said grass turf means to said rigid frame means.

5. A golf practice mat comprising:

(a) a rigid frame;

(b) a ground turf means comprising at least one fabric layer operatively attached to the rigid frame means about the entire perimeter of said fabric layer for absorbing the downward force associated with a descending golf club head during a golf shot in a manner that simulates the ground of a natural golf course; and (c) a grass turf means elastically attached to the rigid frame means and resting on said ground turf means for absorbing the horizontal force associated with a descending golf club head during a golf shot in a manner that simulates the natural grass of a natural golf course.

6. A golf practice mat of claim 5 wherein said grass turf means is a layer of synthetic grass fabric with elastic straps to hold the synthetic grass fabric in place.

7. A golf practice mat of claim 5 wherein said grass turf means is a plurality of layers of fabric netting sewn together along one edge and having a strap attached thereto to tether said grass turf means to said rigid frame means.

* * * * *